US007245232B1

(12) United States Patent
Caouette, Sr.

(10) Patent No.: US 7,245,232 B1
(45) Date of Patent: Jul. 17, 2007

(54) EMERGENCY VEHICLE ALERT SYSTEM

(76) Inventor: James Caouette, Sr., P.O. Box 903115, Palmdale, CA (US) 93590

( * ) Notice: Subject to any disclaimer, the term of this patent is extended or adjusted under 35 U.S.C. 154(b) by 198 days.

(21) Appl. No.: 11/201,921

(22) Filed: Aug. 9, 2005

(51) Int. Cl.
*G08G 1/01* (2006.01)

(52) U.S. Cl. ..... 340/933; 340/935; 340/425.5; 340/435

(58) Field of Classification Search ..... 340/933, 340/935, 907, 425.5, 435, 902, 903, 904; 381/56, 57; 367/118, 124, 199
See application file for complete search history.

(56) References Cited

U.S. PATENT DOCUMENTS 4,806,931 A 2/1989 Nelson
4,956,866 A 9/1990 Bernstein
5,287,411 A * 2/1994 Hill et al. ..... 704/231
5,495,242 A 2/1996 Kick
6,011,492 A * 1/2000 Garesche ..... 340/904
6,133,849 A * 10/2000 McConnell et al. ... 340/825.72
6,404,351 B1 * 6/2002 Beinke ..... 340/902
6,416,021 B2 * 7/2002 Greene, Jr. ..... 246/294
6,980,125 B1 * 12/2005 Barber ..... 340/917

* cited by examiner

*Primary Examiner*—Toan N. Pham
(74) *Attorney, Agent, or Firm*—Dennis W. Beech

(57) ABSTRACT

The emergency vehicle alert system may be used for detection of selected sound frequency signals emitted by warning devices of vehicles. A sensor may sense a selected sound frequency signal spectrum and may be in communication with multiple operational amplifiers. The operational amplifiers may be biased to detect a warning device sound source within 50 feet and within 1,500 feet of the sensor. The detection of a warning device sound source may be communicated to a warning indicator to activate the warning indicator.

7 Claims, 1 Drawing Sheet

EMERGENCY VEHICLE ALERT SYSTEM

BACKGROUND OF THE INVENTION

This invention relates to apparatus for detection of selected sound frequency signals emitted by sirens of emergency vehicles or warning signals from vehicles such as trains. The new apparatus may detect a selected sound frequency signal spectrum emitted by various siren or warning sound sources from at least two distinct distances from a sensor to provide a user with a warning of the presence of an emergency vehicle and the relative distance of the emergency vehicle.

Various types of emergency vehicle siren detection systems may be currently known; however, these systems tend to be complicated, elaborate apparatus. The system may involve digital signal processing and programming as part of the detection and differentiation process for detecting sirens of emergency vehicles. There may be a need for a simple, easy to apply siren or warning signal detection system.

SUMMARY OF THE INVENTION

The present invention is directed to apparatus for detection of selected sound frequency signals emitted by warning devices of vehicles. A sensor may sense a selected sound frequency signal spectrum and may be in communication with multiple operational amplifiers. The operational amplifiers may be biased to detect a warning device sound source within 50 feet and within 1,500 feet of the sensor. The detection of a warning device sound source may be communicated to a warning indicator to activate the warning indicator.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
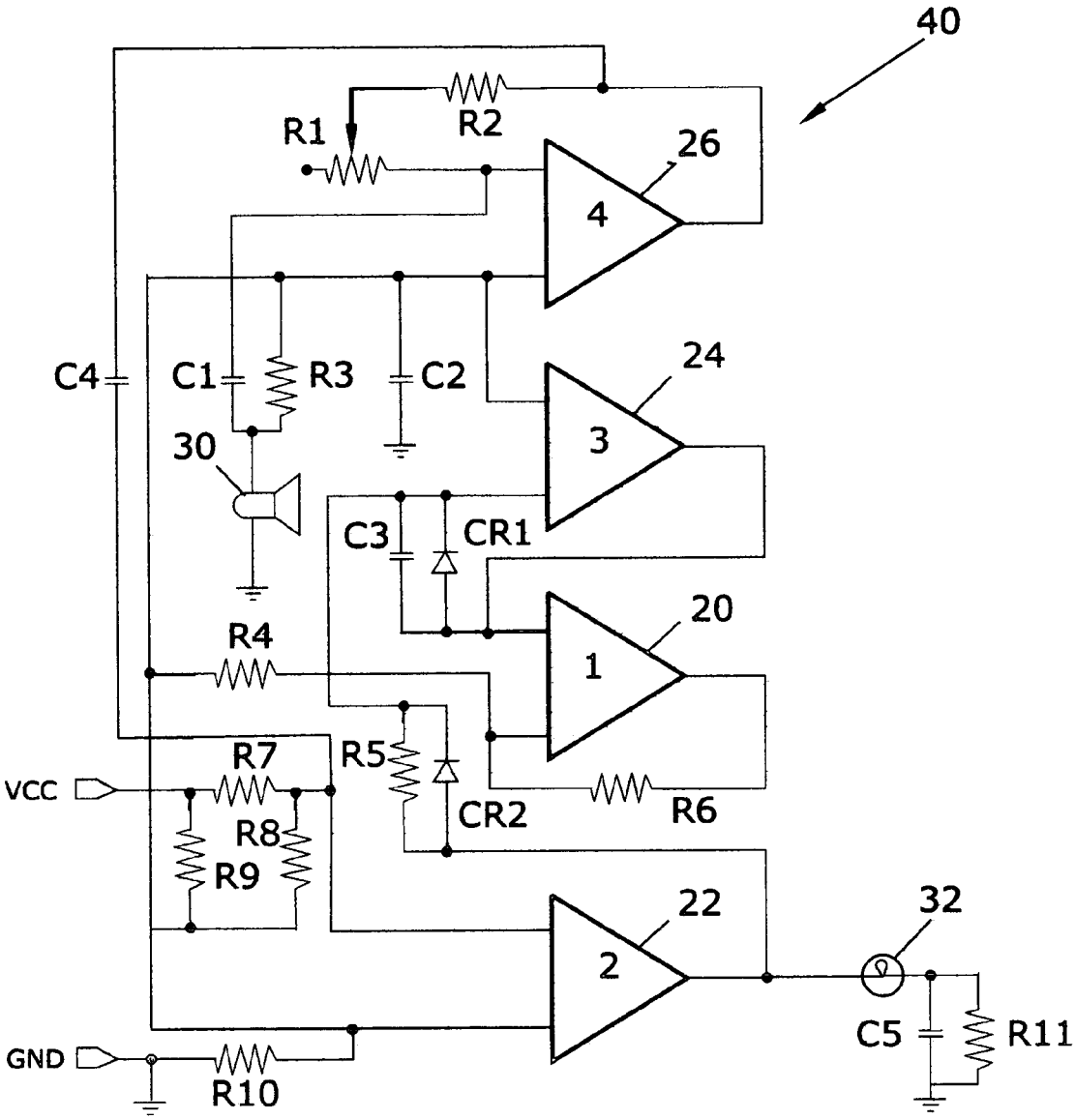
FIG. 1 illustrates a schematic of the emergency vehicle alert system according to an embodiment of the invention.
Figure 2:
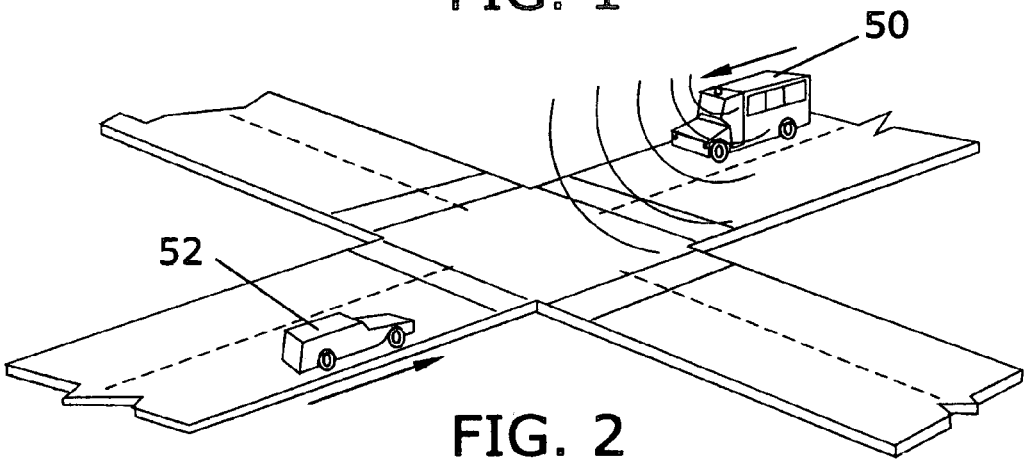
FIG. 2 illustrates a traffic roadway and vehicles according to an embodiment of the invention.

Referring to FIGS. 1 and 2, an emergency vehicle alert system 40 may have four audio frequency selection or detection circuits to detect selected sound frequency spectrum signals that may be transmitted by emergency vehicles 50, such as, ambulances, police cars, fire engines and the like, that may use roadways for travel. Two of the detection circuits with operational amplifiers 20, 24 may be biased to detect the presence of low frequency spectrum sound attributable to warning devices or sirens used by emergency vehicles 50. Two detection circuits with operational amplifiers 22, 26 may be biased to detect the presence of high frequency spectrum sound attributable to sirens of emergency vehicles 50.

The sensing element for the audio sound waves of a warning device or sirens may be a microphone 30 that may be in communication with the operational amplifiers 20, 22, 24, 26 to transmit the desired signal level for the received audio sound frequencies that are to be detected. A prototype circuit using operational amplifiers LM324M was fabricated and tested. Other operational amplifier type may also be used with appropriate selection of other circuit components.

The operational amplifiers 20, 22, 24, 26 may also be biased to detect a received audio sound frequency at 1,500 feet or less and at 50 feet or less. In FIG. 1, the interconnection of components and the operational amplifiers 20, 22, 24, 26 may be selected for biasing amplifier 20 to detect low frequency spectrum sound attributable to a siren source that may be 50 feet or less distance from the sensor 30. Operational amplifier 24 may be biased to detect low frequency spectrum sound attributable to a siren source that may be 1,500 feet or less distance from sensor 30. This combination may allow early warning of an emergency vehicle 50 emitted low frequency siren sound waves at 1,500 feet distance and a heightened alert warning when the emergency vehicle 50 may be within 50 feet of the sensor 30. Such a staged warning system that may provide warning of the presence and relative distance may allow a vehicle 52 driver time to react to avoid any danger associated with the emergency vehicle 50 movement.

Similarly, the operational amplifier 22 may detect high frequency audio sound within 50 feet and the operational amplifier 26 may detect high frequency audio sound within 1,500 feet. A warning indicator 32 that may be connected to the operational amplifiers 20, 22, 24, 26 to have a repetitive low speed flashing illumination when a siren is detected within 1,500 feet of sensor 30 and to have a repetitive high speed flashing illumination when a siren is detected within 50 feet of sensor 30. A variable rate warning indicator 32 compatible with the circuitry of FIG. 1 may be selected to produce the desired effect.

The emergency vehicle alert system 40 may be connected to the vehicle 52 electrical power system and may be mounted adjacent the steering column on the dash board to facilitate warning of the vehicle 52 driver. The emergency vehicle alert system 40 may also have a back up power source in the event the vehicle 52 power source may be interrupted. The sensor 30 may be mounted external to the vehicle 52 interior to improve sensor detection of siren sound waves.

The system 40 has been described relative to emergency vehicle 50 sound detection as for example a sound emitted by a siren; however, other warning sound signals such as a train whistle may also be detected. By selection of appropriate component values in the illustrated circuit for bias and operation of the operational amplifiers 20, 22, 24, 26 a train whistle or other vehicle warning sound may be detected. This additional electronic circuitry may be housed in a common receiver unit with a siren alert system. A separate warning indicator 32 may be located on the receiver unit to identify the type of sound detected.

While the invention has been particularly shown and described with respect to the illustrated embodiments thereof, it will be understood by those skilled in the art that the foregoing and other changes in form and details may be made therein without departing from the spirit and scope of the invention.

I claim:

1. An apparatus to detect selected sound frequency signals emitted by warning devices of vehicles comprising:

a sensor to sense a selected sound frequency signal spectrum in communication with a plurality of operational amplifiers that are in communication with a warning indicator wherein said plurality of operational amplifiers comprising:

a first operational amplifier biased to detect a low frequency signal spectrum within approximately 50 feet of a warning device sound source;

a second operational amplifier biased to detect said low frequency signal of said selected sound frequency signal spectrum within approximately 1,500 feet of said warning device sound source;

a third operational amplifier biased to detect a high frequency signal of said selected sound frequency signal spectrum within approximately 50 feet of said warning device sound source;

a fourth operational amplifier biased to detect said high frequency signal of said selected sound frequency signal spectrum within approximately 1,500 feet of said warning device sound source; and said plurality of operational amplifiers upon detecting said warning device sound source activate said warning indicator.

2. The apparatus as in claim 1 wherein said warning indicator is a light emitting source that is biased to have a repetitive low speed flashing illumination upon signaling of detection of said warning device sound source within approximately 1,500 feet and to have a repetitive high speed flashing illumination upon signaling of detection of said warning device sound source within approximately 50 feet.

3. The apparatus as in claim 1 wherein said sensor is a microphone.

4. The apparatus as in claim 1 wherein said plurality of operational amplifiers are LM324M type devices.

5. The apparatus as in claim 1 wherein said warning device is a siren of an emergency vehicle.

6. The apparatus as in claim 1 wherein said warning device is a whistle of a train.

7. The apparatus as in claim 1 wherein said apparatus is interconnected as illustrated in FIG. 1.

* * * * *